US009447961B1

(12) United States Patent
Yousafi

(10) Patent No.: US 9,447,961 B1
(45) Date of Patent: Sep. 20, 2016

(54) CONVERTIBLE MAGIC LAMP

(71) Applicant: Khan Ali Yousafi, Westbury, NY (US)

(72) Inventor: Khan Ali Yousafi, Westbury, NY (US)

( * ) Notice: Subject to any disclaimer, the term of this patent is extended or adjusted under 35 U.S.C. 154(b) by 120 days.

(21) Appl. No.: 14/584,563

(22) Filed: Dec. 29, 2014

Related U.S. Application Data

(60) Provisional application No. 61/964,305, filed on Jan. 2, 2014.

(51) Int. Cl.

| | |
|---|---|
| ***F21V 3/04*** | (2006.01) |
| ***F21V 33/00*** | (2006.01) |
| ***F21S 6/00*** | (2006.01) |
| ***F21V 23/02*** | (2006.01) |
| ***F21V 23/04*** | (2006.01) |
| ***F21V 17/02*** | (2006.01) |

(52) U.S. Cl.
CPC ..... *F21V 33/0024* (2013.01); *F21S 6/007* (2013.01); *F21V 3/04* (2013.01); *F21V 17/02* (2013.01); *F21V 23/023* (2013.01); *F21V 23/04* (2013.01)

(58) Field of Classification Search
CPC .. F21V 33/0024; F21V 23/023; F21V 23/06; F21V 17/02; F21V 3/00; F21V 3/04; F21S 6/005; F21S 6/007
USPC ..... 439/490, 652
See application file for complete search history.

(56) References Cited

U.S. PATENT DOCUMENTS

| | | | | |
|---|---|---|---|---|
| 1,495,391 | A * | 5/1924 | Baker | F21S 6/007 362/343 |
| 1,966,485 | A * | 7/1934 | Chanock | F21S 6/002 362/247 |
| 2,327,666 | A | 8/1943 | Peterson | |
| 5,545,069 | A | 8/1996 | Glynn et al. | |
| 5,632,553 | A * | 5/1997 | Huang | F21S 6/007 362/220 |
| 6,082,877 | A * | 7/2000 | Hughes | F21S 6/005 362/152 |
| 6,750,410 | B2 * | 6/2004 | Lee | C08J 9/0004 200/51 R |
| 6,860,757 | B2 * | 3/2005 | Herrnring | H01R 31/02 177/264 |
| 6,923,684 | B2 * | 8/2005 | Strayer | H01R 25/006 439/131 |
| 7,897,277 | B2 * | 3/2011 | Meyer | F21L 2/00 429/100 |
| 8,545,039 | B2 | 10/2013 | Patel | |
| 8,783,936 | B2 * | 7/2014 | Chien | F21S 8/035 362/157 |
| 2006/0227559 | A1 | 10/2006 | Migdoll | |
| 2007/0206393 | A1 * | 9/2007 | Soon | F21S 6/002 362/653 |

FOREIGN PATENT DOCUMENTS

CN 202733597 U 2/2013

OTHER PUBLICATIONS

Euro Style Lighting, http://www.eurostylelighting.com/lamp+with+power+outlet-search/search.htm?s=1, four (4) pages, retrieved Dec. 8, 2014.

(Continued)

*Primary Examiner* — Alan Cariaso
(74) *Attorney, Agent, or Firm* — Winston & Strawn LLP

(57) ABSTRACT

An innovative, stylish, convertible freestanding floor lamp that features alternative globe and shade configurations, as well as a digital clock and thermometer, and a base that serves as a multiple-outlet power source and surge-protector. Aesthetically appealing, multifunctional, and designed to be affordable for virtually every consumer, the convertible magic lamp provides ample illumination, time and temperature information, and is a convenient source of electrical power—all inclusive in a single unit.

20 Claims, 4 Drawing Sheets

(56) References Cited

OTHER PUBLICATIONS wayfaircom, http://www.wayfair.com/Fangio-Lighting-20-H-Table-Lamp-with-Drum-Shade-1752XX-F . . . , one(1) page, retrieved Dec. 8, 2014.

Floor lamp doubles as a power strip, http://boingboing.net/2010/05/03/floor-lamp-doubles-a.html, one(1) page, retrieved Dec. 8, 2014.

Lamps Plus, http://www.lampsplus.com/products/jae-brushed-steel-table-lamp-with-power-outlet-6f6 . . . , two (2) pages, retrieved Dec. 8, 2014.

Lite-Source Kade Desk Lamp, http://www1.macys.com/shop/product/lite-source-kade-desk-lamp?ID=1494469&placoun . . . , one(1) page, retrieved Dec. 8, 2014.

* cited by examiner

CONVERTIBLE MAGIC LAMP

This application is a utility application claiming the benefit of U.S. Provisional Application Ser. No. 61/964,305 filed Jan. 2, 2014, the entire content of which is expressly incorporated by reference as if set forth fully herein.

BACKGROUND

1. Field of the Invention

The present invention relates generally to the field of lamps and more specifically relates to floor lamps with power outlets, adjustable pole lengths, convertible lamp shade configurations and multi-purpose features.

2. Description of the Related Art

Many individuals use lamps in modern society for lighting interior spaces. Traditionally, these lamps provide light, but their purpose is singular in nature. It is therefore desirable that a lamp be reconfigurable and multi-purpose to provide both useful and aesthetic features.

Various attempts have been made to solve problems found in lamp art. Among these are found in: U.S. Pub. No. 2006/0227559 to Jerome Migdoll; U.S. Pat. No. 5,545,069 to Kenneth P. Glynn et al; and U.S. Pat. No. 2,327,666 to Viggo Peterson et al. This prior art is representative of lamps. Prior art lamps have typically served only one purpose. For example, they may be aesthetically pleasing, illuminating, serve as power outlets, and/or display the room temperature and/or time. Most of the time, individuals use lamps only to provide light in their homes or offices. There exists a need to have a multi-purpose lamp that can provide light, is aesthetically pleasing, as well as functionally useful in an individual's daily life.

None of the above inventions and patents, taken either singly or in combination, is seen to describe the invention as claimed. Thus, there exists a need for a reliable convertible magic lamp that is reconfigurable and useful for multiple purposes.

SUMMARY OF THE INVENTION

In general, the present invention relates to a floor lamp having a plurality of globes or shades for providing a particular appearance and luminosity to the lamp, with the globes or shades associated with one or more lighting elements. The floor lamp includes a base with a compartment having a circular or polygonal perimeter and a flat or domed upper wall, the compartment housing a plurality of AC power outlets, with the outlets arranged in spaced relation in the upper wall of the base; a supporting rod having first and second ends with the first end connected to the base; a supporting structure associated with the second end of the supporting rod, the supporting structure configured and designed to accommodate one or more of the plurality of globes or shades to change the appearance and luminosity of the lamp when desired.

According to another feature of the present invention, the floor lamp further includes a clock that displays the time of day optionally with the current date, a thermometer that reads the room temperature surrounding the lamp, or a combination of the clock and thermometer. The clock or thermometer or both include a digital display.

The floor lamp of the present invention also features at least 3 to 15 single outlets or 2 to 9 double outlets in the upper wall, with the outlets being symmetrically spaced from each other. Each power outlet includes an on/off switch so that the outlet does not need to be energized unless in use, or the power station and surge protector includes one on/off switch. Lighting elements indicate whether each of the individual power outlets are on/off or whether the power station and surge protector is on/off.

According to a yet further feature of the present invention, the floor lamp includes at least three different size globes or shades, with each globe or shade having the same size base for fitting into the supporting structure. The supporting structure comprises a fixed globe and lighting element that includes an upper portion that is configured and dimensioned for receiving the base of the different sized globes or shades thereupon for support thereof. The different sized globes or shades include a first bowl shaped globe, a second bowl shaped globe that is larger than the first bowl shaped globe, and at least two different diameter ball globes. The base of the fluted neck-fitting of each additional globe includes a lighting element, which can be a light bulb, a light emitting diode, or some other illuminating component.

In addition, the floor lamp includes a supporting rod that is generally cylindrical, extends vertically between the base and the supporting structure, and includes a plurality of securely connectable segments that allow adjustment in length of the rod depending upon how many segments are selected for assembly. The power cord is configured to pass through the segments and is pulled though from the top to the base after the segments are connected. An on/off switch is used to switch the lamp on and off, which is optionally configured with dimmer functionality.

These and other features, aspects, and advantages of the present invention will become better understood with reference to the following drawings, detailed description, and appended claims.

BRIEF DESCRIPTION OF THE DRAWINGS

The figures which accompany the written portion of this specification illustrate embodiments and method(s) of use for the present invention, a convertible magic lamp, constructed and operative according to the teachings of the present invention, wherein.

DETAILED DESCRIPTION OF THE INVENTION

In view of the foregoing disadvantages inherent in the known lamp art, the present invention provides a novel convertible magic lamp. The general purpose of the present invention, which will be described subsequently in greater detail, is to provide an innovative, stylish, convertible free-standing floor lamp that features alternative globe and shade configurations, as well as a digital clock and thermometer, and a weighted base that also serves as a multiple-outlet power source and surge-protector. Aesthetically appealing, multifunctional, and designed to be affordable for virtually every consumer, the magic lamp provides ample illumination, time and temperature information, and a convenient source of electrical power—all in a single unit. The features of the invention are particularly pointed out and distinctly claimed in the appended claims.

The various embodiments of the present invention will hereinafter be described in conjunction with the appended drawings. As discussed above, embodiments of the present invention relate to a lamp device, and more particularly, to a convertible magic lamp that improves the usefulness and aesthetic features of lamps.

Figure 1:
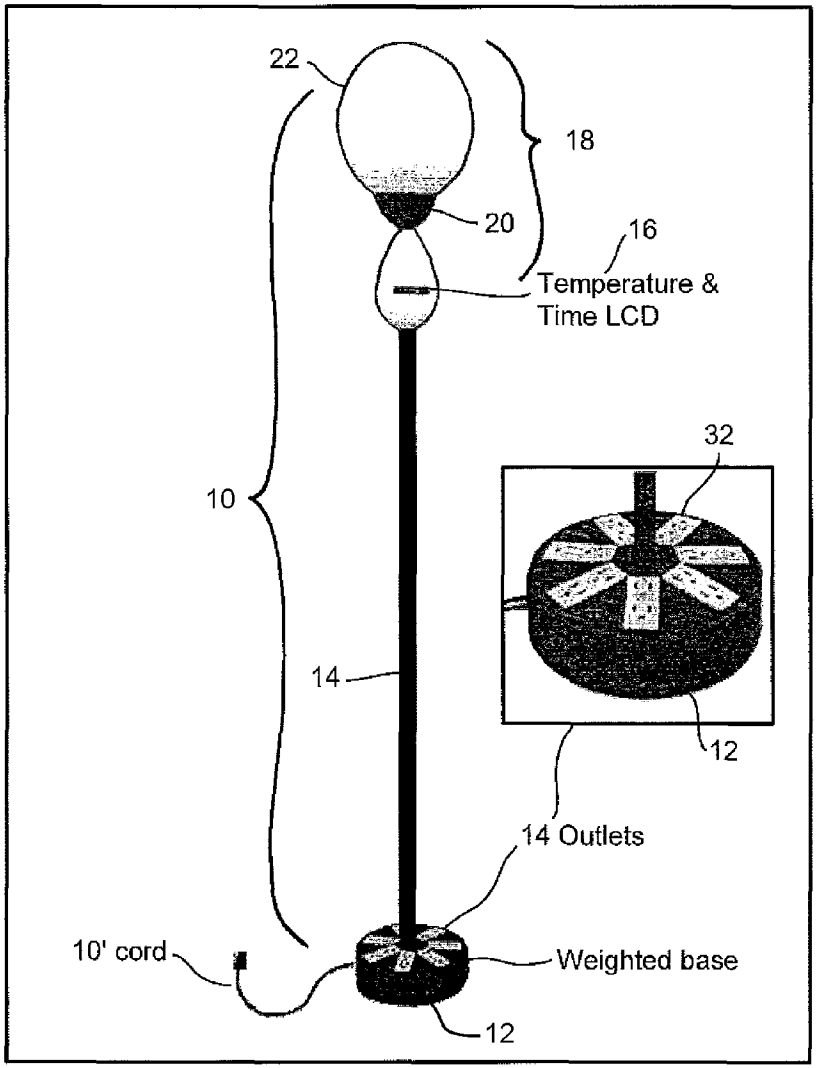
FIG. 1 shows a perspective view illustrating the magic lamp in an in-use condition according to an embodiment of the present invention.

Referring now to the drawings, FIG. 1 shows a perspective depiction of the convertible magic lamp, which in one embodiment comprises a freestanding floor lamp, stylishly designed for good looks and ample illumination, while equipped with features that no other floor lamp can match. In one embodiment, the freestanding floor lamp 10 preferably comprises a round flat base 12 that is typically about 9 inches in diameter and 3 inches in height. Alternatively, the base may be polygonal and also may have a domed, rather than flat, upper wall. The lamp also has a single, centered support rod or shaft 14 about 6 feet in height and ¾-inch in diameter. The support rod or shaft 14 may be one continuous rod or have multiple segments that are connected together (for example, screwed, snap-fit, press-fit into separate or integral fittings, or telescoped together), with one of the two ends connected to the base 12 and the other end connected to a supporting structure, such as a fluted neck-fitting, to support different globes or shades. A subset of the multiple segments of the support rod or shaft may be detachable from the base and support structure segments and removed by disconnecting the ends of the segment and then removing support clips along the vertical axis of the segment. This allows for the support rod or shaft 14 to be adjustable in length depending upon how many segments are selected for assembly. Also, the pole may be made of aluminum, stainless steel, brass or bronze or even of plastic depending upon the final appearance desired for the lamp.

The extraneous power cord from the removed rod segments extends from the light fixture and other electronics on the upper end of the pole and is pulled through the pole segments as they are attached to fix the length of the pole before the cord plug is pulled through the base, extending the length of the power cord to connect to an outlet. When shorter lengths of the pole are used, the base can be configured to provide sufficient space to store a coiled portion of the cord in the base.

The support rod or shaft supports not only an electric lamp with light bulb, but just beneath the lamp, an ovoid, egg- or teardrop-shaped digital display panel 16 that serves to indicate the current time and room temperature. This time-and-temperature display 16 is about 8 inches in maximum height and 5 inches in maximum width in preferred embodiments. The time-and-temperature display 16 may consist of only a clock that displays the time of day (and, optionally, the current date), a thermometer that detects the room temperature, or both. It may also include an analog display or a digital display for the clock, the thermometer, or both. Above this display is the lamp assembly 18, arising from a fluted neck-fitting 20, and consisting of the bulb (not shown) and convertible lamp shade or globe 22. The time/temperature display may be provided in an illuminated housing to contrast with or highlight the display.

Figure 2:
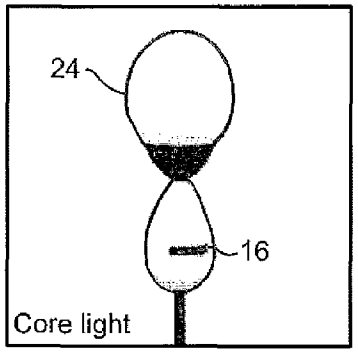
FIG. 2 is a perspective view illustrating a core light globe or lamp shade according to an embodiment of the present invention.
Figure 3:
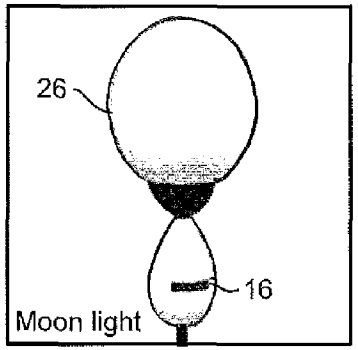
FIG. 3 is a perspective view illustrating a moon light globe or lamp shade according to an embodiment of the present invention.
Figure 4:
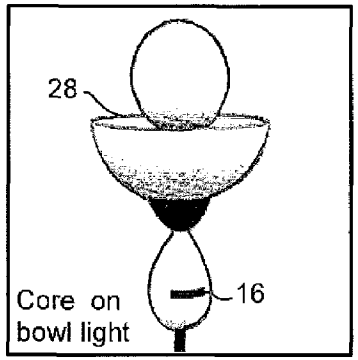
FIG. 4 is a perspective view illustrating a core on bowl light globe or lamp shade according to an embodiment of the present invention.

Referring now to FIGS. 2-4, the magic lamp is preferably equipped with a lamp assembly 18 that has different lamp shades or globes 22. The lamp shade or globe 22 may be a full spherical glass globe 26 in FIG. 3 (also called "moon light"), which is about 15 inches in diameter and producible in a variety of colors; or a "cut boiled egg" half-globe (hemispherical) shade 28 in FIG. 4 (also called "core on bowl light"), which opens upward to cast atmospheric light toward the ceiling using a spherical, smaller "core light"; or just the smaller "core light" 24 in FIG. 2 with a translucent bulb or spherical mini-globe. The exact diameters of the different lamp shades or globes may be the same or different diameters for each of the three different configurations, as desired for the final appearance.

The different lamp shades or globes are all compatible with the fluted neck-fitting 20, and the support rod or shaft 14 connects to the fluted neck-fitting. The base of the fluted neck-fitting 20 comprises of a lighting element to provide illumination from the lamp. Such lighting element may consist of one element or multiple elements, and the lighting element may be a light bulb, light emitting diode, or other similar illuminating component.

In another embodiment, the versatile lamp design of the present invention may be convertible between the three lamp shades or globes shown in FIGS. 2-4. The three lamp shades or globes feature either an adjustable, rotating globe that can close to form a spherical shade 26 or open to form a hemispheric shade design in which two shades (one spherical and one hemispherical), called "core on bowl light" 28, are provided and are easily interchangeable; or perhaps with the inner "core lamp" 24 as the innermost option.

The On/Off switch 30 in FIGS. 6-11 for the magic lamp is preferably a rotary knob situated on the shaft below the time-and-temperature display 16. Alternatively, an On/Off flip switch that may be used to turn on the magic lamp by flipping the switch up and turn off the magic lamp by flipping the switch down may be placed under the time-and-temperature display 16. A particularly useful on-off switch is one that is activated by contacting the upper pole segment, with the number of touches of the pole illuminating an additional globe. The separate On/Off switch 30 may include dimming circuitry or a dimmer switch that allows for adjusting the level of illumination provided by the magic lamp by rotating the rotary knob or sliding the dimmer switch up and down.

Figure 5B:
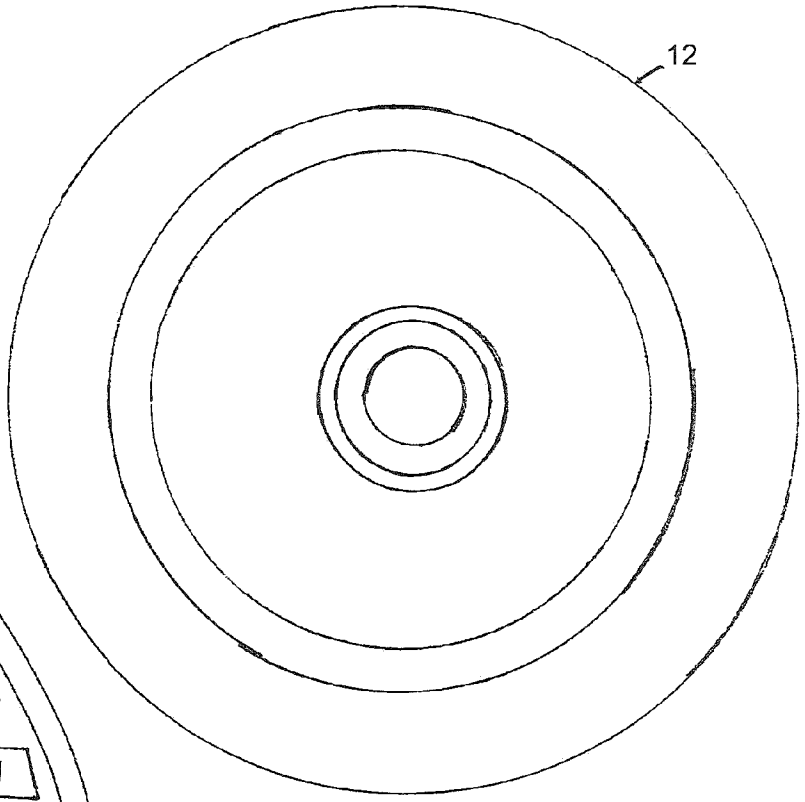
FIG. 5*b* is a view from bottom of the weighted base according to an embodiment of the present invention.
Figure 5C:
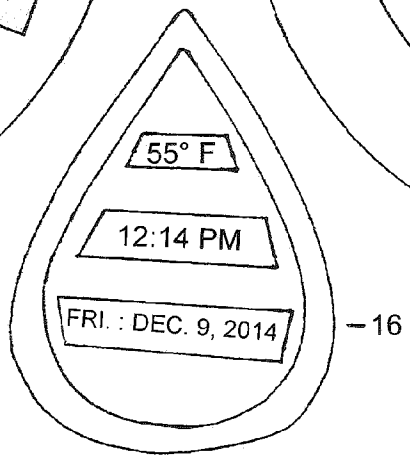
FIG. 5*c* is a perspective view of the time-and-temperature display according to an embodiment of the present invention.
Figure 5A:
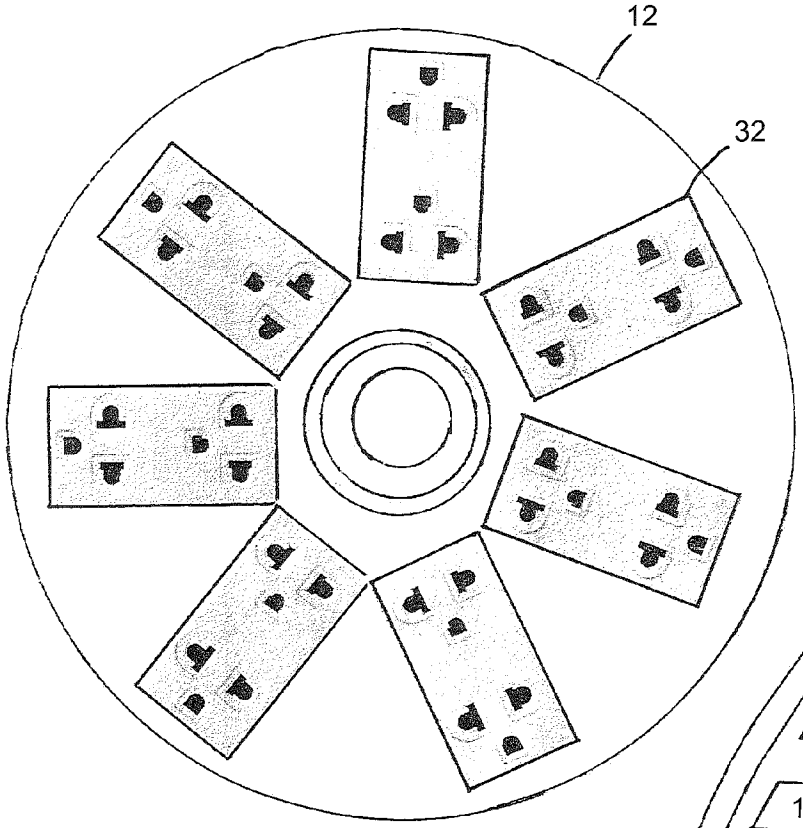
FIG. 5*a* is a view from top of the 14 AC outlets on the weighted base according to an embodiment of the present invention.
Figures 6, 7, 8:
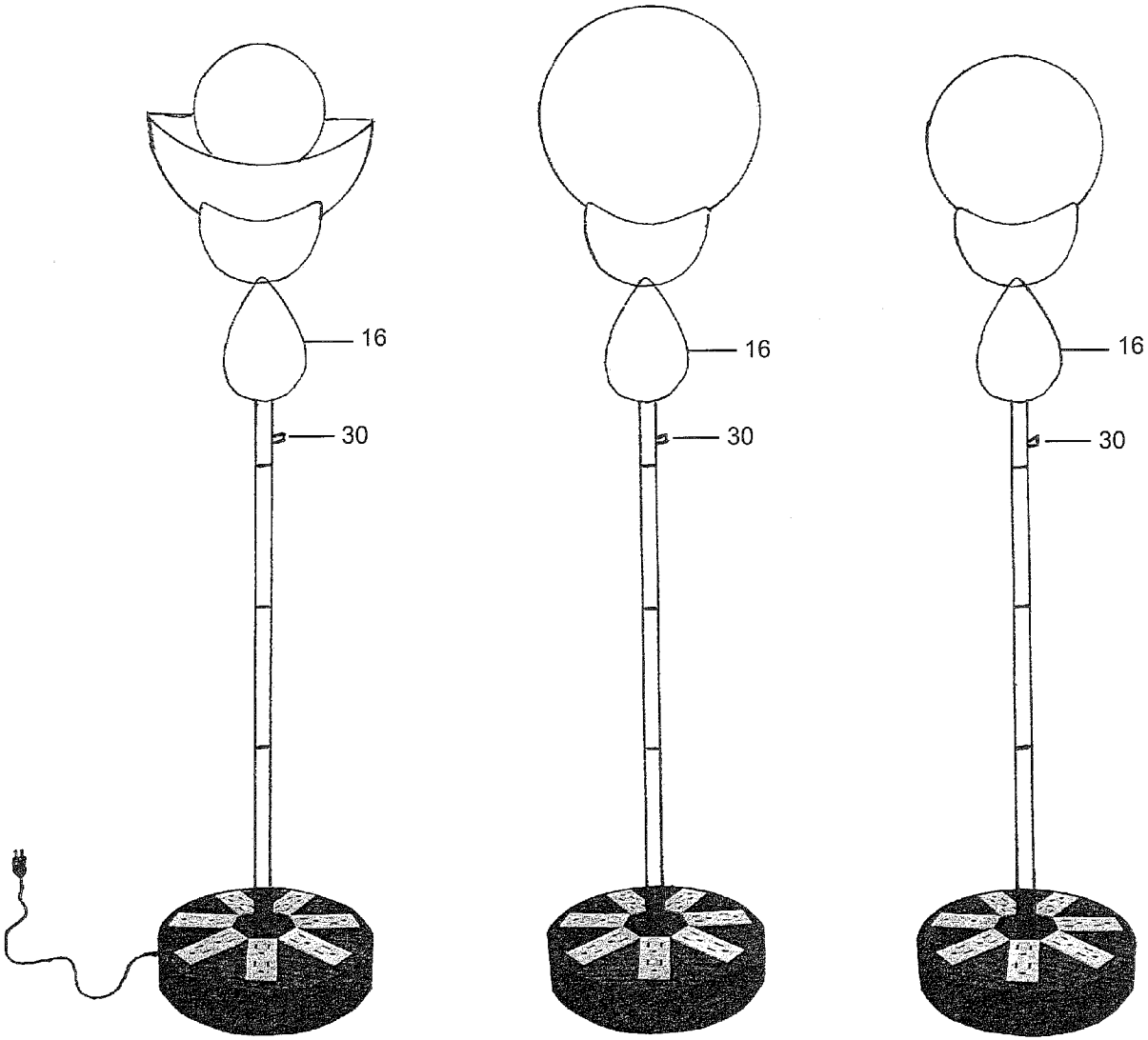
FIG. 6 shows a perspective view illustrating the 6 feet tall magic lamp with core on bowl light globe or lamp shade in an in-use condition according to an embodiment of the present invention.
FIG. 7 shows a perspective view illustrating the 6 feet tall magic lamp with moon light globe or lamp shade in an in-use condition according to an embodiment of the present invention.
FIG. 8 shows a perspective view illustrating the 6 feet tall magic lamp with core light globe or lamp shade in an in-use condition according to an embodiment of the present invention.

FIGS. 5*a-c* illustrate the base of the magic lamp. In one embodiment, the base 12 may be fabricated of a heavy metal or with an internal filling such as concrete for low materials cost and maximum weight and vertical stability. The base 12 may weigh between 5 and 10 pounds, with a steel mesh interior framework and molded concrete construction. Other low cost materials known in the art for providing maximum weight and vertical stability may also be used. The base 12 is unique in that it does far more than simply conceal the power cord and hold the lamp upright.

In FIG. 5*a*, the base 12 of the magic lamp comprises a multi-outlet power station and surge-protector, offering the consumer preferably 14 three-prong, grounded AC outlets 32, which are arranged around the sloping top of the lamp base in radial fashion. In a preferred embodiment, the AC outlets 32 come as double outlets, as is common in the industry, and the 7 double AC outlets 32 are arranged radially around the lamp base. The 7 double AC outlets 32 form a circular power station and surge-protector. A power station and surge-protector is designed to protect electrical devices from voltage spikes, as is known in the art. The wiring for the AC outlets is concealed in the base 12. The 7 double AC outlets power station and surge protector has an on/off switch to turn the power station and surge-protector on or off. When switched off, none of the 7 double AC outlets supply voltage. Alternatively, each of the 7 double AC outlets may have its own on/off switch to individually switch a double outlet 32 on or off. The power station and surge-protector may have a lighting element to indicate whether the power station and surge-protector is on or off. Or, there may be multiple lighting elements to indicate whether each of the individual single or double outlets is on or off.

The circular arrangement of the base, it will be noted, permits the consumer to plug in, for example, multiple charging adapters for devices such as cellular phones and other rechargeables, as the bulky adapters will have plenty of room and does not interfere with one another as they do in a standard linear power bar or power strip. In other embodiments, any arrangement of single or double AC outlets may be implemented in the upper wall of the lamp base in a radial fashion, including as few as 3 single outlets or 2 double outlets to as many as 15 single outlets or 9 double outlets. The precise number of outlets can be varied depending upon the size of the base to accommodate the desired number for a particular end use. The outlets can include an on/off switch which operates one or any combination or even all of the outlets, as desired.

The preferred embodiment of the present invention features the incorporation into the lamp base 12 a 14-outlet 32 circular power station and surge-protector, a centered support rod or shaft 14 (using two detachable segments) about 6 feet in height and ¾-inch in diameter, the time-and-temperature display 16, and a lamp assembly 18 with three interchangeable shades or globes—a large spherical globe 26; a hemispheric or half-globe consisting of two shades (one spherical and one hemispherical) 28; and a smaller "core lamp" globe 24.

Figure 11:
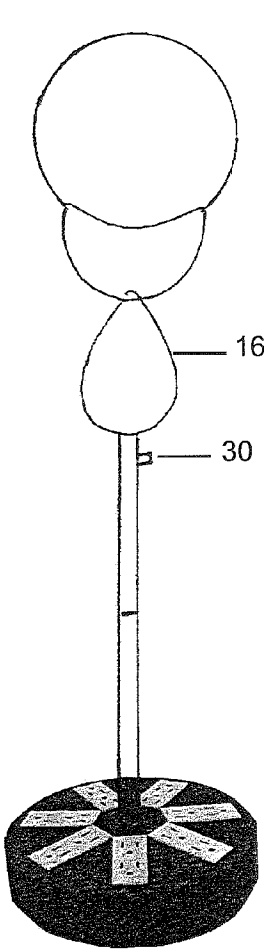
FIG. 11 shows a perspective view illustrating the 2.5 feet tall magic lamp with core light globe or lamp shade in an in-use condition according to an embodiment of the present invention.
Figure 10:
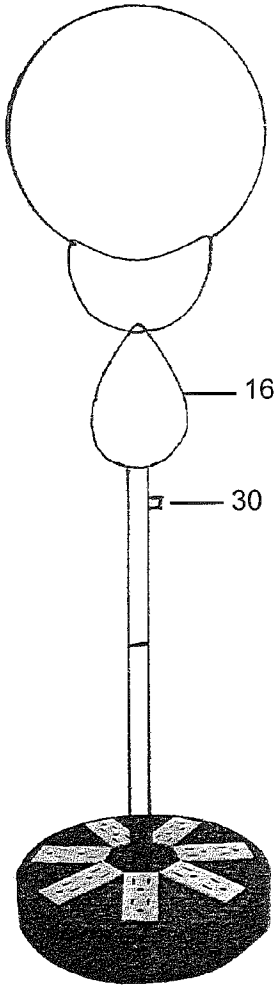
FIG. 10 shows a perspective view illustrating the 2.5 feet tall magic lamp with moon light globe or lamp shade in an in-use condition according to an embodiment of the present invention.
Figure 9:
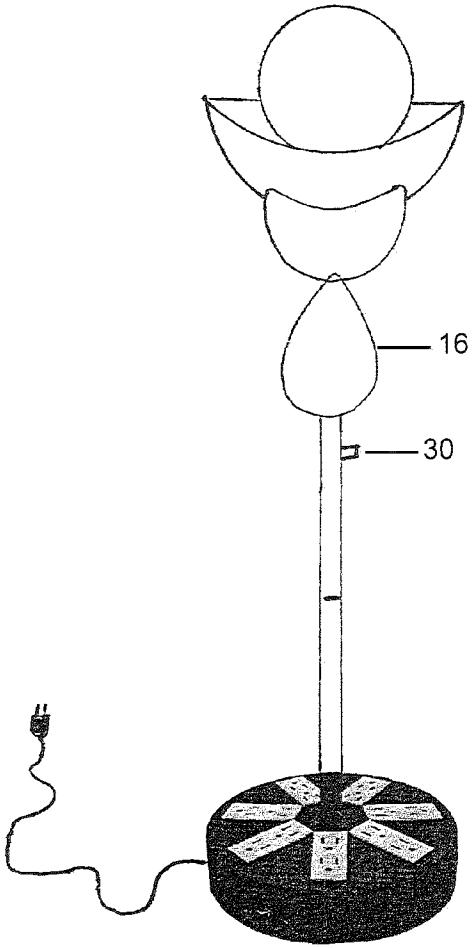
FIG. 9 shows a perspective view illustrating the 2.5 feet tall magic lamp with core on bowl light globe or lamp shade in an in-use condition according to an embodiment of the present invention.

Additional configurations of the magic lamp are shown in FIGS. 6-11 which illustrate various combinations of pole eights and lighting globes. FIGS. 9-11 show an embodiment where the lamp pole is 2.5 feet in height, with the two detachable segments of the rod or shaft 14 from the other figures removed. As such, the magic lamp can be configured to provide brighter or softer illumination and to change a room's atmosphere by using the different heights, globe configurations and dimming to change the direction and intensity of the lamp's light. Further, the magic lamp also provides a central location to which one would look for the current time and room temperature. And finally, with its sturdy 10-foot power cord and a 14-outlet, circular power station and surge protector base, the magic lamp not only serves as a stable, incredibly versatile atmospheric lamp in any room—but also serves as a charging base for a wide array of rechargeable electronic devices, and as a power station for nearby electrical and electronic appliances and systems.

Alternatively, the pole segments that are not used in the shorter versions of the magic lamp can be attached to the bottom of the base that contains the floor to a more accessible position. The pole segments can be attached to a separate base that does not contain any power outlets but which instead is used to support the raised base and remainder of the lamp.

The embodiments of the invention described herein are to be considered exemplary and as illustrative only of the principles of the invention. Numerous modifications, variations, and rearrangements are readily envisioned to achieve substantially equivalent results by those skilled in the art, all of which are intended to be embraced within the spirit and scope of the invention. For example, the magic lamp of the invention with its relatively high number of outlets, is ideally situated for use in areas that are subject to the presence of multiple people that require charging of cell phone or other electronic equipment, such as an airport gate waiting area. The magic lamp can be configured with the base located a three feet above the floor to make the outlets easily accessible to the waiting passengers. Further, the purpose of the foregoing detailed description of the invention is to enable the U.S. Patent and Trademark Office and the public generally, and especially the scientists, engineers, and practitioners in the art, to determine quickly from a cursory inspection the nature and essence of the technical disclosure of the application. It is not desired to limit the invention to the exact constructions and operations shown and described herein.

What is claimed is:

1. A magic floor lamp device comprising:

a plurality of interchangeable globes or shades of different sizes and shapes for providing a particular appearance and luminosity to the lamp, with the globes or shades associated with one or more lighting elements, wherein the globes or shades include a first bowl shaped globe, a second bowl shaped globe that is larger than the first bowl shaped globe, and at least two different diameter ball globes;

a base that includes a compartment having a circular or polygonal perimeter and a flat or domed upper wall, the compartment housing a plurality of AC power outlets, with the outlets arranged in spaced relation in the upper wall of the base;

a supporting rod having first and second ends with the first end connected to the base and with the rod and second end extending vertically from the base; and a supporting structure associated with the second end of the supporting rod, the supporting structure configured and designed to alternatively accommodate one of the plurality of interchangeable globes or shades to change the appearance and luminosity of the lamp when desired, wherein the supporting structure comprises a globe and lighting element that includes an upper portion that is configured and dimensioned for receiving the different sized globes or shades thereupon for support thereof.

2. The magic floor lamp device of claim 1, which further includes a clock that displays the time of day optionally with the current date, a thermometer that reads the room temperature surrounding the lamp, or a combination of the clock and thermometer.

3. The magic floor lamp device of claim 2, wherein the clock or thermometer or both include a digital display.

4. The magic floor lamp device of claim 1, wherein at least 3 to 15 single outlets or 2 to 9 double outlets are provided in the upper wall, with the outlets being symmetrically spaced from each other.

5. The magic floor lamp device of claim 1, where each power outlet includes an on/off switch so that the outlet does not need to be energized unless in use.

6. The magic floor lamp device of claim 5, wherein each power outlet includes a lighting element that indicates whether each power outlet is on or off.

7. The magic floor lamp device of claim 1, wherein each globe or shade has the same size base for fitting into the upper portion of the supporting structure.

8. The magic floor lamp device of claim 7, wherein the upper portion of the supporting structure comprises a fluted neck fitting that is configured and dimensioned for receiving the base of the different sized globes or shades thereupon for support thereof, with each globe or shade having the same size base for fitting into the fluted neck fitting.

9. The magic floor lamp device of claim 8, further comprising an on/off switch for the globe and lighting element wherein the on/off switch optionally is configured with dimmer functionality.

10. The magic floor lamp device of claim 7, wherein each interchangeable globe or shade includes a lighting element therein, wherein each lighting element is a light emitting diode.

11. The magic floor lamp device of claim 1, wherein the supporting rod is generally cylindrical, extends vertically between the base and the supporting structure, and includes a plurality of securely connectable segments that allow adjustment in length of the rod depending upon how many segments are selected for assembly.

12. The magic floor lamp of claim 11, wherein each segment is configured with an open interior to allow a power cord and plug to pass through the segments when the plug is pulled though from adjacent the globe(s) to the base after the segments are connected.

13. The magic floor lamp device of claim 1, wherein the base has a round perimeter and a flat upper wall that houses seven double power outlets.

14. The magic floor lamp device of claim 13, wherein the seven double power outlets which collectively include an on/off switch so that the outlets do not need to be energized unless in use.

15. The magic floor lamp device of claim 14, wherein the seven double power outlets include a lighting element that indicates whether the power outlets are on or off.

16. The magic floor lamp of claim 1, wherein the base is sufficiently heavy to allow the floor lamp to be freestanding; and the supporting rod comprises a tube that has a height of between 2.5 and 6 feet and is made of aluminum, stainless steel; brass; bronze or plastic in the form of one continuous tube or in multiple tube segments that are connected together to form the rod.

17. The magic floor lamp of claim 1, further comprising a separate base that does not contain outlets, wherein the tube of the supporting rod is made in multiple tube segments, one or more of which are detachable from the base that contains the outlets or from the supporting structure to allow the tube to be adjustable in length, with the removed tube segment(s) forming a second supporting rod that has one end attached to the separate base and an opposite end attached to the bottom of the base that contains the outlets to provide the outlets in a raised and more accessible position.

18. The magic floor lamp of claim 1, further comprising an on/off switch for the globe and lighting element wherein the on/off switch is activated by contacting the tube or tube segment and is also configured with dimmer functionality; and wherein the base that contains the outlets houses at least seven double power outlets or fourteen power outlets that are symmetrically spaced from each other on the upper wall of the base, with each power outlet including a lighting element that indicates whether each power outlet is on or off and an on/off switch so that each outlet does not need to be energized unless in use.

19. A magic floor lamp device comprising:

a plurality of interchangeable globes or shades for providing a particular appearance and luminosity to the lamp, with the globes or shades associated with one or more lighting elements, with the different sized globes or shades including a first bowl shaped globe, a second bowl shaped globe that is larger than the first bowl shaped globe, and at least two different diameter ball globes;

a base that includes a compartment having a circular or polygonal perimeter and a flat or domed upper wall, the compartment housing at least 3 to 15 single outlets or 2 to 9 double outlets which are provided in the upper wall, with the outlets being symmetrically spaced from each other with each power outlet including a lighting element that indicates whether each power outlet is on or off, and with the base having a weight of between 5 and 10 pounds to allow the floor lamp to be freestanding;

a supporting structure comprising a fluted neck fitting that is configured and dimensioned to support one of the interchangeable globes or shades to change the appearance and luminosity of the lamp when desired, with each globe or shade having the same size base for fitting into the fluted neck fitting;

an upstanding, straight, vertical supporting rod having a height of between 2.5 and 6 feet and made of aluminum, stainless steel, brass, bronze or plastic in the form of a tube or multiple tube segments that are connected together to form the rod, with the rod having one end connected to the base and an opposite end connected to the supporting structure, and with the supporting rod configured with an open interior to allow a power cord and plug to pass through the segments when the plug is pulled though from adjacent the globe or shade to the base; and a clock that displays the time of day optionally with the current date, a thermometer that reads the room temperature surrounding the lamp, or a combination of the clock and thermometer wherein the clock and/or thermometer are mounted on the supporting rod.

20. The magic floor lamp of claim 19, further comprising a separate base that does not contain outlets, wherein the tube of the supporting rod is made in multiple tube segments, one or more of which are detachable from the base that contains the outlets or from the supporting structure to allow the tube to be adjustable in length, with the removed tube segment(s) forming a second supporting rod that has one end attached to the separate base and an opposite end attached to the bottom of the base that contains the outlets to provide the outlets in a raised and more accessible position.

* * * * *